US012152335B2

(12) United States Patent
Bae et al.

(10) Patent No.: US 12,152,335 B2
(45) Date of Patent: Nov. 26, 2024

(54) LAUNDRY TREATMENT APPARATUS

(71) Applicant: LG Electronics Inc., Seoul (KR)

(72) Inventors: Jinwoo Bae, Seoul (KR); Yeonju Lee, Seoul (KR); Jongmin Lee, Seoul (KR); Hyunwoo Noh, Seoul (KR)

(73) Assignee: LG Electronics Inc., Seoul (KR)

( * ) Notice: Subject to any disclaimer, the term of this patent is extended or adjusted under 35 U.S.C. 154(b) by 640 days.

(21) Appl. No.: 17/466,876

(22) Filed: Sep. 3, 2021

(65) Prior Publication Data

US 2022/0074118 A1 Mar. 10, 2022

(30) Foreign Application Priority Data

Sep. 4, 2020 (KR) ..... 10-2020-0113079

(51) Int. Cl.
*D06F 58/20* (2006.01)
*D06F 58/08* (2006.01)

(52) U.S. Cl.
CPC ..... *D06F 58/206* (2013.01); *D06F 58/08* (2013.01)

(58) Field of Classification Search
CPC ..... D06F 58/206; D06F 58/08
USPC ..... 34/595–610
See application file for complete search history.

(56) References Cited

U.S. PATENT DOCUMENTS 1,578,298 A * 3/1926 Walsh ..... F26B 13/14 34/422
2,314,748 A * 3/1943 White ..... D06F 58/02 200/61.58 R
3,805,404 A * 4/1974 Gould ..... D06F 58/04 34/77
5,755,040 A * 5/1998 Ou ..... D06F 58/10 34/225

(Continued)

FOREIGN PATENT DOCUMENTS

CN 105220425 B * 5/2018 ..... D06F 58/206
DE 102015209113 A1 * 12/2015 ..... D06F 58/206

(Continued)

OTHER PUBLICATIONS

Office Action in Korean Appln. No. 10-2020-0113079, mailed on Oct. 24, 2023, 10 pages (with English translation).

(Continued)

*Primary Examiner* — Stephen M Gravini
(74) *Attorney, Agent, or Firm* — Fish & Richardson P.C.

(57) ABSTRACT

A laundry treatment apparatus includes a drum, a stator and a rotor configured to rotate the drum, a fixing panel that is spaced apart from the rear cover, that supports the stator, and that defines a panel exhaust port and a supply port, the supply port including a plurality of through-holes that pass through the fixing panel and surround the stator, and a duct body fixed to the fixing panel and configured to guide the air discharged from the panel exhaust port to the supply port. The plurality of through-holes include (i) first through-holes defined above a horizontal line passing through a center of (Continued)

the rotor and (ii) second through-holes defined below the horizontal line, where a number of the first through-holes is greater than a number of the second through-holes, or a total area of the first through-holes is greater than a total area of the second through-holes.

20 Claims, 6 Drawing Sheets

(56) References Cited

U.S. PATENT DOCUMENTS

| | | | | |
|---|---|---|---|---|
| 8,245,414 | B2 * | 8/2012 | Watson | D06F 58/10 68/18 F |
| 9,488,412 | B2 * | 11/2016 | Yu | D06F 58/206 |
| 11,692,292 | B2 * | 7/2023 | Yong | D06F 25/00 68/5 R |
| 11,891,749 | B2 * | 2/2024 | Borgerson | D06F 58/20 |
| 11,976,409 | B2 * | 5/2024 | Graeser | D06F 58/20 |
| 12,000,081 | B2 * | 6/2024 | Ekbundit | D06F 58/32 |
| 12,012,689 | B2 * | 6/2024 | Oak | D06F 58/24 |
| 2004/0010936 | A1 | 1/2004 | Han | |
| 2009/0211309 | A1 | 8/2009 | Kawabata et al. | |
| 2012/0011738 | A1 | 1/2012 | Ashrafzadeh et al. | |
| 2016/0201252 | A1 * | 7/2016 | Lee | D06F 58/206 34/130 |
| 2018/0094376 | A1 | 4/2018 | Kitayama | |
| 2022/0074118 | A1 * | 3/2022 | Bae | D06F 58/02 |

FOREIGN PATENT DOCUMENTS

| | | | | | |
|---|---|---|---|---|---|
| EP | 2990521 | | | 3/2016 | |
| JP | 2006-230471 | | | 9/2006 | |
| JP | 2014199172 | | | 10/2014 | |
| JP | 2019-97580 | | | 6/2019 | |
| JP | 2019-136287 | | | 8/2019 | |
| JP | 2023540100 | A | * | 9/2023 | |
| KR | 10-2002-0038303 | | | 5/2002 | |
| KR | 20050119257 | | | 12/2005 | |
| KR | 100568521 | | | 4/2006 | |
| KR | 100751801 | | | 8/2007 | |
| KR | 10-2007-0101383 | A | | 10/2007 | |
| KR | 20200066169 | | | 6/2020 | |
| KR | 20220031822 | A | * | 3/2022 | |
| WO | WO-2022050757 | A1 | * | 3/2022 | D06F 58/02 |

OTHER PUBLICATIONS

Office Action in Japanese Appln. No. 2023-514481, mailed on Nov. 28, 2023, 13 pages (with English translation).

Extended European Search Report in European Appln. No. 21194771.8, dated Jan. 3, 2022, 8 pages.

International Search Report and Written Opinion in International Appln. No. PCT/KR2021/011924, dated Dec. 15, 2021, 11 pages.

Notice of Allowance in Korean Appln No. 10-2020-0113079, mailed on Jul. 15, 2024, 2 pages (with English Translation).

* cited by examiner

LAUNDRY TREATMENT APPARATUS

CROSS-REFERENCE TO RELATED APPLICATION

This application claims the benefit of Korean Patent Application No. 10-2020-0113079, filed on Sep. 4, 2020, which is hereby incorporated by reference as if fully set forth herein.

TECHNICAL FIELD

The present disclosure relates to a laundry treatment apparatus.

BACKGROUND

Generally, a laundry treatment apparatus may refer to an apparatus for washing laundry, an apparatus for drying wet or washed laundry, and/or an apparatus for performing washing and drying of laundry.

A washing machine may include a tub to store water, a washing drum provided in the tub to store laundry, and a driver (also called a washing driver) to rotate the washing drum. A drying machine may include a drying drum to store laundry, a driver (also called a drying driver) to rotate the drying drum, and a heat exchanger to dehumidify moisture from the laundry by supplying air to the drying drum.

The washing driver may include a stator fixed to the tub to generate a rotating magnetic field, a rotor configured to rotate by the rotating magnetic field, and a rotary shaft configured to interconnect the washing drum and the rotor by penetrating the tub, the drying driver of the conventional drying machine may include a motor, a pulley fixed to a rotary shaft of the motor, and a belt (i.e., a power transmission unit) configured to supply rotational motion of the pulley to the drying drum.

The washing driver may be configured to interconnect the washing drum and the rotor through the rotary shaft of the motor. In order to wash or dehydrate laundry, the washing driver should control the washing drum to rotate at a high RPM (revolutions per minute) or should perform switching of a rotation direction of the washing drum. Therefore, assuming that the washing drum and the rotor are directly connected to each other through the rotary shaft of the motor, the number of revolutions (e.g., RPM) and the rotation direction of the washing drum can be easily controlled.

Generally, the conventional drying driver may be configured to interconnect the drying drum and the rotary shaft of the motor through a power transmission unit such as a belt. There is little need for the drying machine to continuously maintain a high RPM of the drying drum or to change the rotation direction of the drying drum, so that no problems may occur in the case where the drying drum rotates through the power transmission unit such as a belt. However, assuming that the RPM and the rotation direction of the drying drum are changed, it is possible to control movement of laundry in the drying drum, so that a total drying time of the drying machine can be shortened and drying performance of the drying machine can increase.

A representative example of the conventional washing machines is disclosed in Korean Patent Laid-Open Publication No. 10-2004-0071426, which includes a driver (e.g., a decelerator and a motor) capable of reducing the number of revolutions per minute (RPM) of the rotor and transmitting the reduced RPM to a drum. The conventional washing machine including a decelerator and a motor has been configured in a manner that a stator of the motor and the decelerator are fixed to a tub. That is, the stator included in the conventional washing machine is fixed to the tub without being directly fixed to the decelerator, so that a vibration width of the stator and a vibration width of the decelerator may be different from each other. The above-mentioned driver have disadvantages in that it is difficult to maintain not only concentricity between an input shaft connected to the rotor and an output shaft connected to the drum during rotation of the tub and the drum, but also the spacing between the stator and the rotor during rotation of the tub and the drum.

In addition, each of the conventional laundry treatment apparatuses capable of drying laundry includes a supply passage through which air flows into the drum. In this case, the supply passage may be configured in a manner that the amount of air supplied to an upper space of the drum is greater than the amount of air supplied to a lower space of the drum.

During rotation of the drum, laundry moves from the lower space to the upper space of the drum and is then tumbled or tangled in the lower space of the drum. In this case, when the large amount of air is supplied to the upper space of the drum, there is a higher possibility of contact between the air and the laundry in the drum.

SUMMARY

Accordingly, the present disclosure is directed to a laundry treatment apparatus that substantially obviates one or more problems due to limitations and disadvantages of the related art. An object of the present disclosure is to provide a laundry treatment apparatus for supplying much more air to an upper region of a drum, thereby facilitating heat exchange between laundry and the air in the drum.

Another object of the present disclosure is to provide a laundry treatment apparatus provided with a driver that decreases a rotational speed of a rotor and transmits the decreased rotation speed to the drum, so that the center of rotation of the rotor and the center of rotation of the drum can form a concentric axis.

In accordance with one aspect of the present disclosure, a laundry treatment apparatus may include a drum configured to include a drum body providing a space in which laundry is stored, a front cover forming a front surface of the drum body, a rear cover forming a rear surface of the drum body, and a drum inlet penetrating the front cover, a fixing panel provided to be spaced apart from the rear cover, a driver configured to include a stator supported by the fixing panel to form a rotating magnetic field, and a rotor rotated by the rotating magnetic field to generate power required to rotate the drum, a panel exhaust port provided to penetrate the fixing panel; an exhaust duct configured to guide air discharged from the drum to the panel exhaust port, a heat exchanger configured to include a fan for enabling air to move along the exhaust duct, a heat absorption unit for dehumidifying air introduced into the exhaust duct, and a heating unit for heating air having penetrated the heat absorption unit, a supply port configured to allow a plurality of through-holes penetrating the fixing panel to surround the stator, an air inlet formed to penetrate the rear cover, a flow passage forming portion, one end of which is fixed to the fixing panel and the other end of which contacts the rear cover, configured to interconnect the supply port and the air inlet, a supply duct configured to include a duct body that is fixed to the fixing panel to guide air discharged from the panel exhaust port to the supply port, and a rotor reception portion formed to penetrate the duct body so that the rotor is exposed to the outside of the duct body. The supply port is configured in a manner that the number of through-holes disposed over a horizontal line penetrating a center of rotation of the rotor is greater than the number of other through-holes disposed below the horizontal line, or is configured in a manner that the sum of areas of the through-holes disposed over the horizontal line is greater than the sum of areas of the other through-holes disposed below the horizontal line.

The laundry treatment apparatus may further include a barrier configured to enable the inside of the duct body to be classified into a first flow passage connected to some of the through-holes and a second flow passage connected to the remaining through-holes other than the some through-holes. From among a space disposed over the horizontal line, the barrier may be located at a specific position where the barrier is spaced apart from a reference line that penetrates a center of the rotor and a center of the panel exhaust port toward a direction in which the panel exhaust port is disposed.

The first flow passage may be configured to form a flow passage for guiding air in a direction opposite to a rotational direction of the fan, and the second flow passage may be configured to form a flow passage for guiding air in the same direction as the rotational direction of the fan, wherein the number of through-holes formed to receive air from the first flow passage is different from the number of through-holes formed to receive air from the second flow passage.

The number of through-holes formed to receive air from the first flow passage may be greater than the number of through-holes formed to receive air from the second flow passage.

The first flow passage may have a longer length than the second flow passage.

The duct body may include an inner body fixed to the fixing panel to form the rotor reception portion, an outer body fixed to the fixing panel to surround the inner body, and a cover body configured to interconnect a free end of the inner body and a free end of the outer body, wherein the barrier is provided in at least one of the inner body, the outer body, and the cover body.

The barrier may be provided as a protrusion for interconnecting the cover body and the fixing panel.

The barrier may be provided as a protrusion that protrudes from the cover body toward the fixing panel, wherein a free end of the protrusion is not in contact with the fixing panel.

The barrier may be implemented as any one of a protrusion formed to protrude from the inner body toward the outer body and a protrusion formed to protrude from the outer body toward the inner body.

The barrier may be provided as a curved surface where the cover body is bent toward the fixing panel, wherein a free end of the curved surface is connected to the fixing panel.

The barrier may be provided as a curved surface where the cover body is bent toward the fixing panel, wherein a free end of the curved surface is not in contact with the fixing panel.

The curved surface may include a first inclined surface where the cover body is inclined downward toward the fixing panel, and a second inclined surface where the cover body is inclined downward toward a free end of the first inclined surface.

The laundry treatment apparatus may further include a communication hole formed to penetrate the outer body, a connection body configured to interconnect the communication hole and the panel through-hole, and a guide configured to protrude from the inner body toward the communication hole so that some of air discharged from the communication hole is guided to the first flow passage and the remaining air other than the some air is guided to the second flow passage.

The driver may include a housing fixed to the fixing panel to allow the stator to be fixed thereto, a ring gear fixed to the inside of the housing, a first shaft, one end of which is fixed to the rotor and the other end of which is disposed in the housing, a main gear fixed to the first shaft and disposed in the housing, a second shaft formed to penetrate the fixing panel in a manner that one end of the second shaft is fixed to the rear cover and the other end of the second shaft is disposed in the housing, thereby forming a concentric axis along with the first shaft, a base disposed in the housing so that the other end of the second shaft is fixed thereto, and a slave gear configured to include a first body rotatably fixed to the base, a first gear provided at a circumferential surface of a first body and coupled to the main gear, a second body fixed to the first body and having a smaller diameter than the first body, and a second gear provided at a circumferential surface of the second body and coupled to the ring gear.

The air inlet may be configured in a manner that a plurality of holes penetrating the rear cover forms a ring surrounding a center of rotation of the drum, and a radius of the ring forming the air inlet is set to at least ½ of a radius of the rear cover.

As is apparent from the above description, the laundry treatment apparatus according to the embodiments of the present disclosure can supply much more air to an upper region of a drum, thereby facilitating heat exchange between laundry and the air in the drum.

The laundry treatment apparatus may include a driver that decreases a rotation speed of a rotor and transmits the decreased rotation speed to the drum, so that the center of rotation of the rotor and the center of rotation of the drum can form a concentric axis.

DETAILED DESCRIPTION

Reference will now be made in detail to the preferred embodiments of the present disclosure, examples of which are illustrated in the accompanying drawings. Meanwhile, elements or control method of apparatuses which will be described below are only intended to describe the embodiments of the present disclosure and are not intended to restrict the scope of the present disclosure. Wherever possible, the same reference numbers will be used throughout the drawings to refer to the same or like parts.

Figure 1:
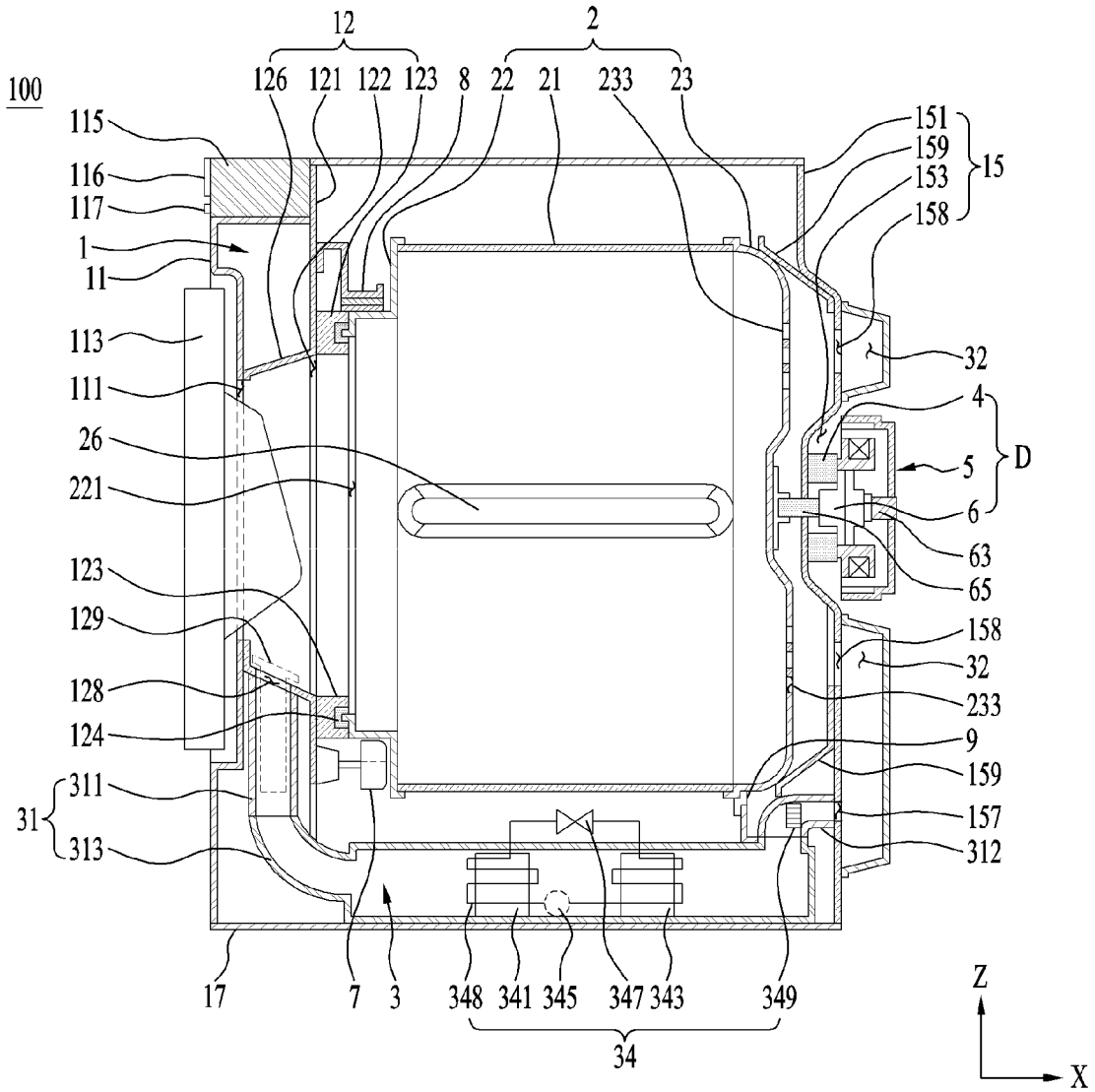
FIGS. 1 and 2 are schematic diagrams illustrating examples of a laundry treatment apparatus according to the present disclosure.

FIG. 1 is a schematic diagram illustrating an example of a laundry treatment apparatus 100. The laundry treatment apparatus 100 may include a cabinet 1, a drum 2 rotatably provided in the cabinet 1 to provide a space in which laundry (to be washed or to be dried) is stored, a drum 3 to remove moisture or humidity from laundry by supplying high-temperature drying air (e.g., air having a higher temperature than room temperature, or air having a higher dryness than room temperature) to the drum 2, and a driver D to rotate the drum.

The cabinet 1 may include a front panel 11 forming a front surface of the laundry treatment apparatus, and a base panel 17 forming a bottom surface of the laundry treatment apparatus. The front panel 11 may include an inlet 111 formed to communicate with the drum 2. Here, the inlet 111 may be closed by a door 113.

The front panel 11 may include a control panel 115. The control panel 115 may include an input unit 116 to receive a control command from a user, and a display unit 117 to output (or display) information such as a user-selectable control command. The input unit 116 may include a power-supply request unit to request power supply from the laundry treatment apparatus, a course input unit to enable the user to select a desired course from among a plurality of courses, and an execution request unit to request initiation of the course selected by the user.

The drum 2 may be formed in a hollow cylindrical shape. Referring to FIG. 1, the drum 2 may include a cylindrical drum body 21, a front surface and a rear surface of which are opened, a front cover 22 forming the front surface of the drum body 21, and a rear cover 23 forming the rear surface of the drum body 21. The front cover 22 may include a drum inlet 221 for enabling the inside of the drum body 21 to communicate with the outside of the drum body 21.

The drum body 21 may further include a lifter 26. The lifter 26 may be implemented as a board that protrudes from the front cover 22 toward the rear cover 23. The lifter 26 may protrude from the drum body 21 to the center of rotation of the drum 2. That is, the lifter 25 may protrude from the circumferential surface of the drum toward the center of rotation of the drum.

When the laundry treatment apparatus 100 is implemented as a device for drying laundry only, the drum 2 need not have a drum through-hole formed to penetrate the drum body 21 so as to allow the inside of the drum 2 to communicate with the outside of the drum 2.

The drum 2 may be rotatably fixed to at least one of a first body support 12 and a second body support 15. In FIG. 1, the rear cover 23 may be rotatably fixed to the second body support 15 through the driver D, and the front cover 22 may be rotatably connected to the first body support 12.

The front support 12 may be provided as a support panel 121 that is fixed to the cabinet 1 and disposed between the front panel 11 and the front cover 22. As can be seen from FIG. 1, the support panel 121 may be fixed to the base panel 17 so that the support panel 121 is disposed between the front panel 11 and the front cover 22. In this case, the rear surface (facing the support panel) of the front panel 11 may be fixed to the front support 12, and may be fixed to the base panel 17.

The first body support 12 may include a support panel through-hole 122, a drum connection body 123 formed to interconnect the support panel through-hole 122 and the drum inlet 221, and a panel connection body 126 formed to interconnect the support panel through-hole 122 and the inlet 111. The support panel through-hole 122 may be formed to penetrate the support panel 121 so that the inlet 111 and the drum inlet 221 may be formed to communicate with each other through the support panel through-hole 122.

The drum connection body 123 may be implemented as a pipe that is fixed to the rear surface (facing the drum inlet from among the space provided by the support panel) of the support panel 121. One end of the drum connection body 123 may be provided to surround the support panel through-hole 122, and a free end of the drum connection body 123 may be provided to support the front cover 22. In other words, the free end of the drum connection body 123 may be inserted into the drum inlet 221, or may be provided to contact the free end of the front cover 22 forming the drum inlet 221.

FIG. 1 illustrates one example in which the free end of the drum connection body 123 is in contact with the free end of the front cover 22. In this case, the drum connection body 123 may include a ring-shaped damper (also called a connection damper) 124. The connection damper 124 may minimize the risk that the drum inlet 221 is separated from the drum connection body 123 when the drum 2 rotates or vibrates, so that the possibility of air leaking from the drum toward the cabinet can also be minimized.

The connection damper 124 may be formed of a compressible material, the volume of which can increase or decrease by external force. In this case, the connection damper 124 may be provided to maintain a compressed state between the free end of the drum connection body 123 and the edge (i.e., the free end of the front cover) of the drum inlet 221. Alternatively, the connection damper 124 may be provided to maintain a compressed state by a rear support to be described later. As a result, the possibility that the drum inlet 221 is separated from the drum connection body 123 when the drum 2 vibrates between the support panel 121 and the fixing panel 151 can be minimized. A felt manufactured by compression of fibers may be an example of the connection damper 124.

The panel connection body 126 may be implemented as a pipe that is fixed to the front surface (facing the front panel from among the space provided by the support panel) of the support panel 121. One end of the panel connection body 126 may be provided to surround the support panel through-hole 122, and the other end of the panel connection body 126 may be connected to the inlet 111. Therefore, laundry supplied to the inlet 111 may move to the drum body 21 through the panel connection body 126, the support panel through-hole 122, the drum connection body 123, and the drum inlet 221.

The second body support 15 may be provided as the fixing panel 151 that is fixed to the cabinet 1 in a manner that the second body support 15 is arranged to be spaced apart from the rear cover 23. FIG. 1 illustrates one example in which the fixing panel 151 is fixed to the base panel 17, resulting in formation of the rear surface (i.e., the rear surface of the cabinet) of the laundry treatment apparatus 100.

Figure 2:
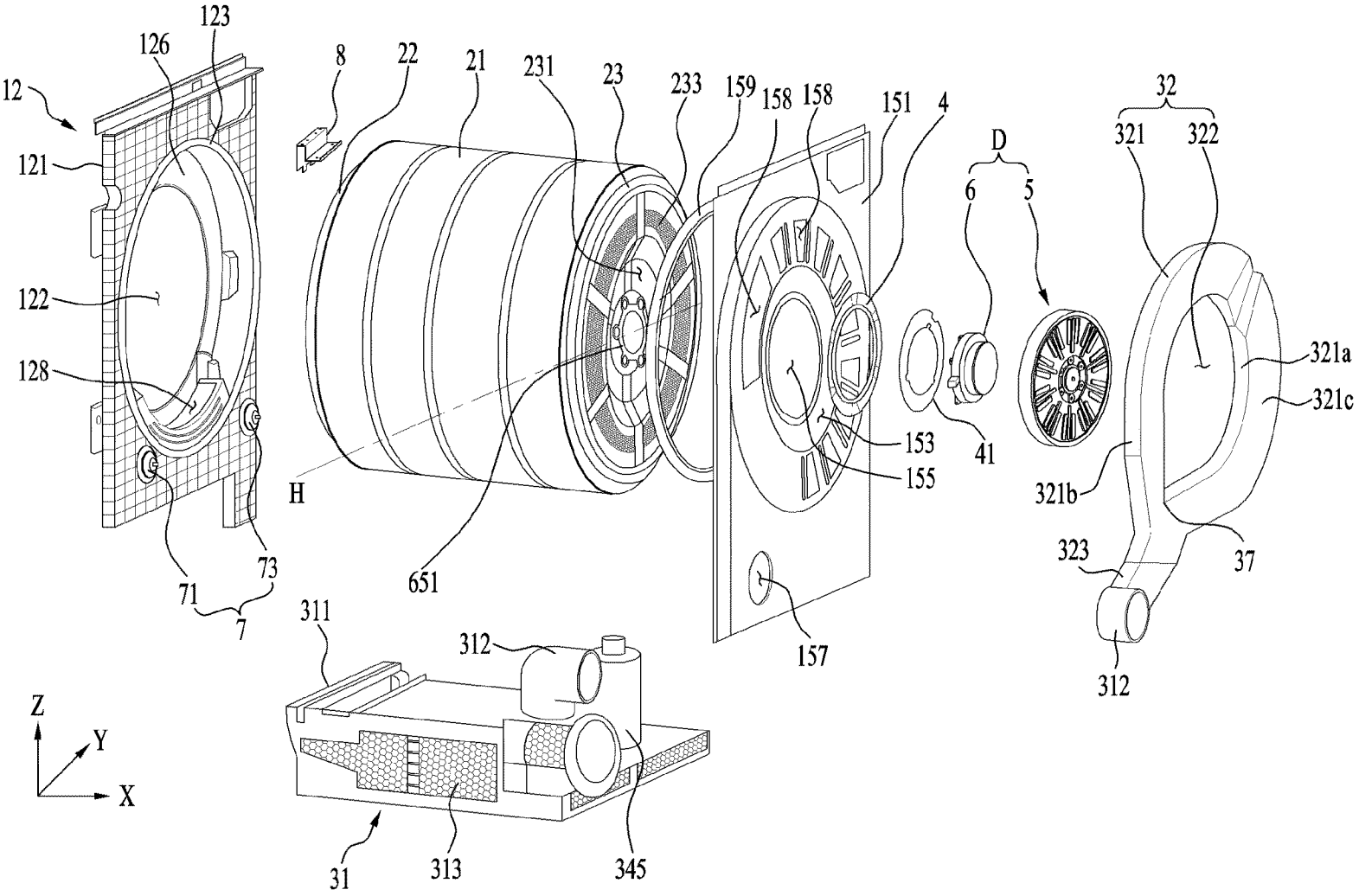

Referring to FIG. 2, the fixing panel 151 may be provided a driver mounting groove 153 providing a space in which the driver D is mounted. The driver mounting groove 153 may be implemented as a groove formed when the fixing panel 151 is concavely curved toward the rear cover 23 of the drum. The fixing panel 151 may include a fixing panel through-hole 155 through which the rotary shaft of the drum 2 passes, and the fixing panel through-hole 155 may be disposed in the driver mounting groove 153.

As described above, when the drum 2 includes the drum body 21, the front cover 22 fixed to the drum body 21, and the rear cover 23 fixed to the drum body 21, the drum 2 may have a higher rigidity than the other drum in which the opened front surface and the opened rear surface of the drum body 21 are rotatably coupled to the support panel 121 and the fixing panel 151, respectively. If the rigidity of the drum increases, it is possible to minimize deformation of the drum body 21 during rotation of the drum 2. As a result, when deformation of the drum body 21 occurs, it may be possible to minimize the number of unexpected problems in which laundry is caught either in a gap between the drum body 21 and the support panel or in a gap between the drum body 21 and the fixing panel 151 due to such deformation of the drum body 21. Namely, load of the driver can be minimized.

The support panel 121 may include a drum exhaust port (e.g., a first exhaust port 128) configured to penetrate the panel connection body 126. The fixing panel 151 may include a panel exhaust port (e.g., a second exhaust port 157) and a support port 158.

The supply port 158 may be configured in a manner that the supply holes formed to penetrate the fixing panel 151 surround the driver mounting grove 153. Here, the supply holes may be configured to form a ring surrounding the driver mounting groove.

Referring to FIG. 1, a supply unit 3 may include an exhaust duct 31 for connecting the first exhaust port 128 to the second exhaust port 157, a supply duct for guiding air discharged from the second exhaust port 157 to the supply port 158, and a heat exchanger 34 provided in the exhaust duct to sequentially perform dehumidification and heating of the air. The first exhaust port 128 may include a filter 129 to filter air moving in the direction from the drum 2 to the exhaust duct 31.

The exhaust duct 31 may include a first duct 311 connected to the first exhaust port 128, a second duct 312 connected to the second exhaust port 157, and a third duct 313 configured to interconnect the first duct 311 and the second duct 312. The third duct 313 may be fixed to the base panel 17.

The heat exchanger 34 may be implemented as various devices capable of sequentially performing dehumidification and heating of air introduced into the exhaust duct 31. FIG. 1 illustrates one example in which the heat exchanger 34 includes a heat pump and a fan 349.

That is, the heat exchanger 34 shown in FIG. 1 may include a first heat exchanger (i.e., a heat absorption unit 341) for dehumidifying the air introduced into the exhaust duct 31, a second heat exchanger (i.e., a heating unit 343) provided in the exhaust duct 31 to heat the air having penetrated the heat absorption unit 341, and the fan 349 for allowing the air discharged from the drum 2 to sequentially pass through the heat absorption unit and the heating unit so that the resultant air flows into the supply duct 32. FIG. 1 illustrates one example in which the fan 349 is included in the second duct 312.

The heat absorption unit 341 and the heating unit 343 may be sequentially arranged in the direction of air flow, so that the heat absorption unit 341 and the heating unit 343 may be connected to each other through a refrigerant pipe 348 forming a circulation passage of the refrigerant. The refrigerant may move along the refrigerant pipe 348 by a compressor 345 located outside the exhaust duct 31. The refrigerant pipe 348 may include a pressure regulator 347 to adjust a pressure of the refrigerant flowing from the heating unit 343 to the heat absorption unit 341.

The heat absorption unit 341 may transmit heat of air introduced into the exhaust duct 31 to the refrigerant, so that the air is cooled and the refrigerant is evaporated. The heating unit 343 may transmit heat of the refrigerant having penetrated the compressor 345 to the air, so that the air is heated and the refrigerant is condensed.

Referring to FIG. 2, the supply duct 32 may be fixed to the fixing panel 151, so that the supply duct 32 can guide the air discharged from the second exhaust port 156 to the supply port 158.

When the supply port 158 is implemented as a plurality of supply through-holes arranged in a ring shape, the supply duct 32 may include a duct body 321 fixed to the fixing panel 151 to interconnect the second exhaust port 157 and the supply port 158, a rotor reception portion 322 configured to penetrate the duct body 321, a connection body 323 configured to interconnect the second duct and the duct body 321. The supply duct including the duct body 321 and the rotor reception portion 322 may form an approximately ring-shaped passage. The driver D fixed to the driver mounting groove 153 may be exposed to the outside of the supply duct 32 by the rotor reception portion 322.

The duct body 321 may include an inner body 321*a* fixed to the fixing panel 151 to form the rotor reception portion 322, an outer body 321*b* fixed to the fixing panel 161 to surround the inner body 321*a*, and a cover body 321*c* configured to interconnect a free end of the inner body 321*a* and a free end of the outer body 321*b*. The connection body 323 may be connected to the duct body 321 through a communication hole 321*d* (see FIG. 6) formed to penetrate the outer body 321*b*.

The drum 2 may include an air inlet 233 formed to penetrate the rear cover 23, so that air supplied to the inside of the cabinet 1 can flow into the drum 2. The fixing panel 151 may include a flow passage forming portion 159 to guide air discharged from the supply port 158 to the air inlet 233.

The air inlet 233 may be configured in a manner that several holes penetrating the rear cover 23 form the ring surrounding the center of rotation of the drum 2. The flow passage forming portion 159 may be implemented as a pipe in which one end (i.e., one end fixed to the fixing panel) surrounds the supply port 158 and the other end (i.e., one end contacting the drum) surrounds the air inlet. In order to minimize vibrations that are generated by rotation of the drum 2 and then applied to the fixing panel 151, the flow passage forming portion 159 may be formed of a high-elasticity material such as rubber.

A radius of the ring formed by the air inlet 233 (i.e., a radius of the inner body or a radius of the outer body) may be set to at least ½ of the radius of the rear cover 23. As a result, air flowing in the drum through the air inlet 233 can move along the circumferential surface of the drum.

The driver D may include a motor 5 disposed in the driver mounting groove 153, and a power transmission unit 6 fixed to the fixing panel 151 to transmit power generated by the motor 5 to the drum 2.

In order to minimize deformation of the fixing panel 151 due to external force generated by the weight and operation of the driver D, the driver mounting groove 153 may be provided with a driver bracket 4 for providing a spacing in which at least one of the motor 5 and the power transmission unit 6 is fixed. That is, the power transmission unit 6 may be fixed to the driver bracket 4, and the motor 5 may be fixed to at least one of the power transmission unit 6 and the driver bracket 4. The driver bracket 4 may be formed of a ring-shaped metal (i.e., metal having a higher strength than the fixing panel) fixed to the driver mounting groove 153.

Figure 3:
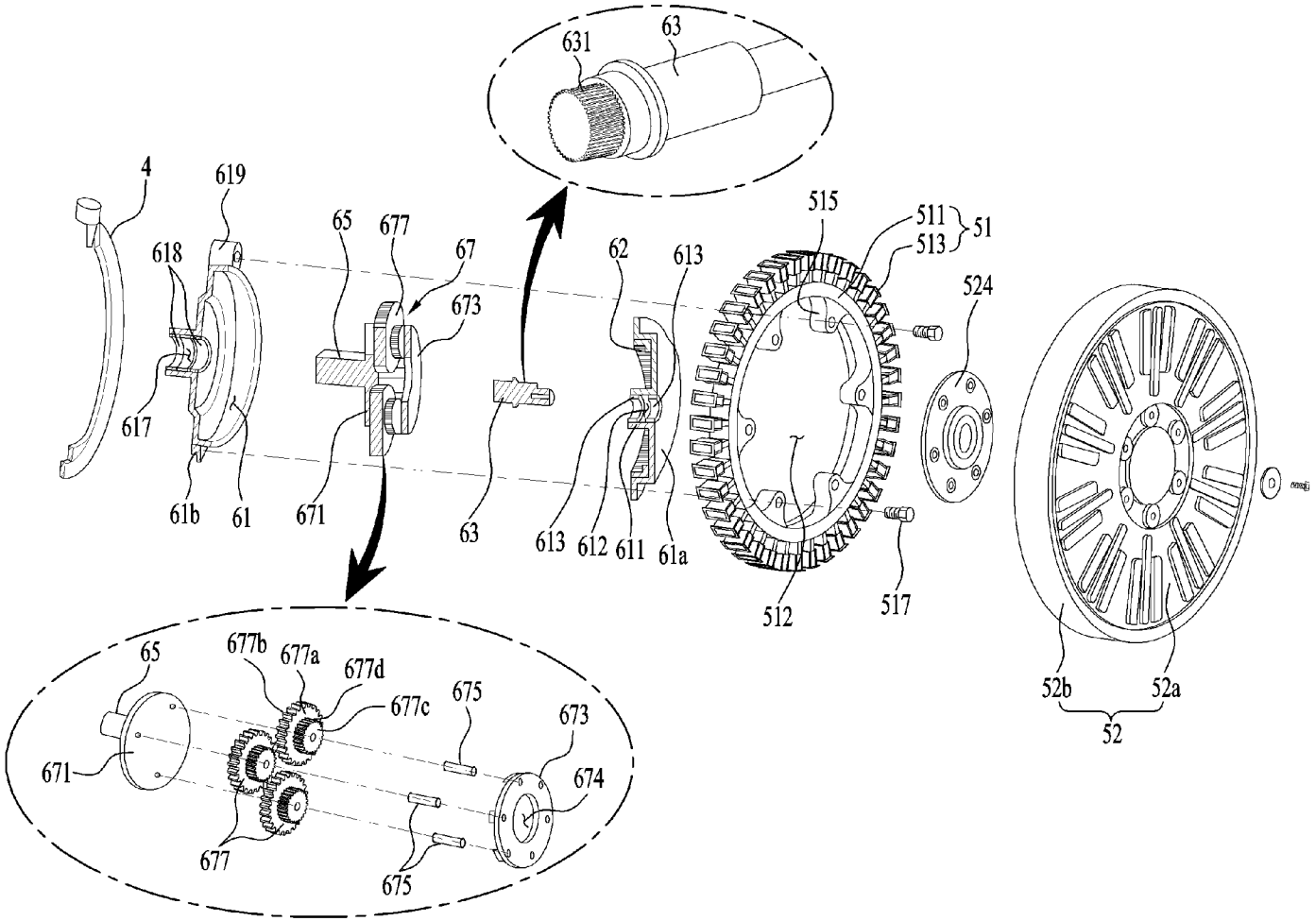
FIG. 3 is a schematic diagram illustrating examples of a driver according to the present disclosure.

Referring to FIG. 3, the motor may include a stator 51 forming a rotating magnetic field, and a rotor 52 rotated by the rotating magnetic field.

The stator 51 may include a core 511 fixed to the driver bracket 4 or the power transmission unit 6, a core through-hole 512 formed to penetrate the core 511, and electromagnets 513 (i.e., coils) arranged at regular intervals on the circumferential surface of the core 511.

The rotor 52 may include a disc-shaped rotor body 52, a pipe-shaped rotor circumferential surface 52*b* fixed to the rotor body 52*a*, and a plurality of permanent magnets 525 fixed to the rotor circumferential surface. The permanent magnets 525 may be fixed to the rotor circumferential surface 52*b* in a manner that N poles and S poles of the permanent magnets 525 are alternately exposed.

The power transmission unit 6 may include a housing 61 formed in a hollow cylindrical shape and fixed to the fixing panel 151, a ring gear 62 fixed to the inside of the housing 61, a first shaft 63 (i.e., an input shaft), one end of which is fixed to the rotor body 52*a* and the other end of which is disposed in the housing 61, a main gear 631 fixed to the first shaft 63 and disposed in the housing 61, a slave gear 677 configured to interconnect the main gear 631 and the ring gear 62, a cage 67 configured to rotate in the housing 61 by the slave gear 677, and a second shaft 65 (i.e., an output shaft), one end of which is fixed to the rear cover 23 and the other end of which is fixed to the cage 67.

In order to minimize deformation of the rotor body 52 affected by the first shaft 63, the first shaft 63 may be fixed to the rotor body 52*a* through a fixing plate 524.

Preferably, the second shaft 65 may be arranged to form a concentric axis along with the first shaft 63. If the second shaft 65 and the first shaft 63 are arranged to form the concentric axis, the amount of vibration generated in the power transmission unit 6 during rotation of the drum 2 can be minimized.

Preferably, the housing 61 may be fixed to the fixing panel 151 through the driver bracket 4 so that the housing may be disposed in the core through-hole 512. Since the housing 61 is disposed in the core through-hole 512, the volume of the driver D can be minimized.

The housing 61 may include a first cylindrical housing 61*a* in which one surface facing the fixing panel 151 is opened, and a second cylindrical housing 61*b* having one surface facing the first housing 61*a* is opened. The second cylindrical housing 61*b* may close the open surface of the first housing 61*a* by connecting to the first housing 61*a*.

The first housing 61*a* may include a first shaft support 611, and a first shaft through-hole 612 formed to penetrate the first shaft support 611. The first shaft 63 may be inserted into the first shaft through-hole 612, so that the first shaft 63 can penetrate the first housing 61*a*. The first shaft support 611 may include a first shaft bearing 613 so that the first shaft 63 can be rotatably fixed to the first housing 61*a*.

Figure 4:
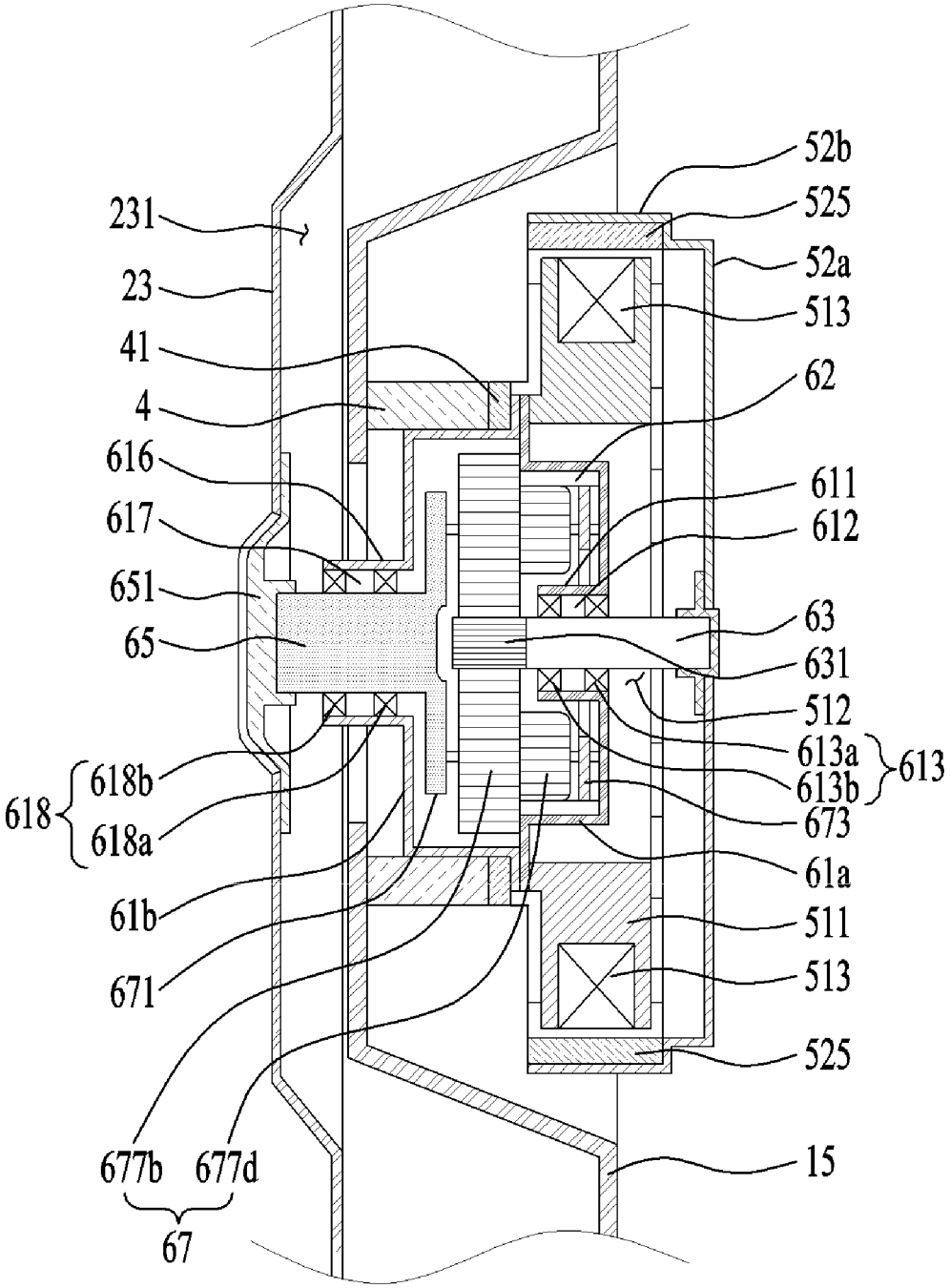
FIGS. 4 and 5 are schematic diagrams illustrating examples of a power transmission unit according to the present disclosure.

Referring to FIG. 4, the first shaft support 611 may be provided as a pipe that protrudes from the first housing 61*a* toward the second housing 61*b*. If the first shaft support 611 is provided as a pipe protruding from the first housing 61*a* toward the second housing 61*b*, the volume of the housing 61 can be minimized (i.e., the volume of the driver can be minimized, and the volume of the laundry treatment apparatus can also be minimized).

The second housing 61*b* may include a second shaft support 616 and a second shaft through-hole 67 formed to penetrate the second shaft support 616. The second shaft 65 may penetrate the second housing 61*b* through the second shaft through-hole 617. The second shaft support 616 may include a second shaft bearing 618 by which the second shaft 65 is rotatably fixed to the second housing 61*b*.

The second shaft support 616 may be implemented as a pipe (i.e., a pipe protruding toward the rear cover of the drum) protruding from the second housing 61*b* toward the fixing panel through-hole 155.

The first shaft bearing 613 may include a first-shaft first bearing 613*a* and a first-shaft second bearing 613*b* that are disposed in a longitudinal direction of the first shaft 63. The second shaft bearing 618 may include a second-shaft first bearing 618*a* and a second-shaft second bearing 618*b* that are disposed in a longitudinal direction of the second shaft 65.

When the first shaft bearing is implemented as two or more bearings 613*a* and 613*b* and the second shaft bearing is implemented as two or more bearings 618*a* and 618*b*, the eccentricity of both the first shaft 63 and the second shaft 65 during rotation of the rotor 52 can be minimized (i.e., vibration generated in the driver can be minimized).

Since several bearing should be disposed along the rotary shaft, the volume of the driver D including the plurality of bearings unavoidably increases. Accordingly, it is difficult to design the plurality of bearings capable of supporting the rotary shaft in the laundry treatment apparatus 100 provided with the cabinet 1 having a limited volume. However, the above-mentioned laundry treatment apparatus 100 can minimize the volume of the driver through a structure in which the housing 61 is disposed in the core through-hole of the stator and a pipe structure in which the first shaft support 611 is formed to protrude toward the center of the housing 61, so that the number of bearings 613 and 618 can increase.

In order to minimize the volume of the housing 61, the diameter of the first housing 61*a* and the diameter of the second housing 61*b* may be configured to be different from each other. That is, the diameter of the first housing 61*a* may be configured to be shorter than the diameter of the second housing 61*b*, or may be configured to be longer than the diameter of the second housing 61*b*.

The ring gear 62 may include a ring gear body, a ring gear body through-hole formed to penetrate the ring gear body, and gear teeth provided along the inner circumferential surface of the ring gear body (i.e., the circumferential surface forming the ring gear body through-hole).

The ring gear 62 may be fixed to a smaller one (having a smaller diameter) from among the first housing 61*a* and the second housing 61*b*. As shown in the drawings, when the diameter of the first housing 61*a* is shorter than the diameter of the second housing 61*b*, the ring gear 62 may be fixed to the circumferential surface of the first housing 61*a*.

As shown in FIG. 3, the cage 67 may include a base 671 disposed in the housing 61, a connection shaft 675 for enabling the slave gear 677 to be rotatably fixed to the base 671, and a ring-shaped base cover 673 fixed to one end of the connection shaft 675.

The second shaft 65 may be inserted into the fixing panel through-hole 155, so that the second shaft 65 may interconnect the base 671 and the rear cover 23 of the drum. In order to prevent the rear cover 23 from being destroyed by rotation of the second shaft 65, the rear cover 23 may include a shaft bracket 651 (see FIG. 3) to which one end of the second shaft 65 is fixed.

As shown in FIG. 2, in order to minimize an increase in the volume of the drum affected by the shaft bracket 651, the rear cover 23 may include a shaft bracket mounting groove 231 to which the shaft bracket 651 is fixed. The shaft bracket mounting groove 231 may be formed as a groove that is bent in the direction in which the rear cover 23 moves away from the fixing panel 151. Preferably, the shaft bracket mounting groove 231 may be disposed at the same location as the driver mounting groove 153, and the diameter of the shaft bracket mounting groove 231 may be longer than the diameter of the driver mounting groove 153. As a result, the possibility of the rear cover 23 colliding with the driver mounting groove 153 during rotation of the drum 2 can be minimized.

The slave gear 677 may be implemented as a plurality of gears spaced apart from each other at intervals of the same angle. FIG. 3 illustrates one example in which the slave gear 677 is implemented as three gears spaced apart from each other by an angle of 120° and the connection shaft 675 is implemented as three shafts spaced apart from each other at intervals of 120°.

Each of the slave gears 677 may include a first body 677*a* rotatably fixed to the base 671 through the connection shaft 675, a first gear 677*b* provided at the circumferential surface of the first body 677*a* and coupled to the main gear 631, a second body 677*c* fixed to the first body 677*a* and having a smaller diameter than the first body 677*a*, and a second gear 677*d* provided at the circumferential surface of the second body 677*c* and coupled to the ring gear 62.

Referring to FIG. 4, the main gear 631 fixed to the free end of the first shaft 63 may be disposed in the space between the slave gears so that the main gear 631 can be coupled to each of the first gears 677*b*. In addition, the free end of the first shaft support 611 may be inserted into a base cover through-hole 674 formed at the center of the base cover 673. The above-mentioned structure (i.e., the structure including the first shaft support and the base cover) can minimize the volume of the above housing, so that the volume of the driver can also be minimized.

In order to seal the fixing panel through-hole 155 (i.e., in order to prevent air supplied to the drum from leaking to the outside of the cabinet), the driver bracket 4 or the fixing panel 51 may further include a sealing portion 41. The driver bracket 4 may be formed in a ring shape surrounding the fixing panel through-hole 155. The housing 61 may be fixed to the driver bracket 4 and disposed in the core through-hole 512. When the core 511 is fixed to the housing, the sealing portion 41 may be formed to seal the space between the driver bracket 4 and the second housing 61*b*.

Referring to FIG. 3, when the stator 51 is fixed to the housing 61, the core 511 may be provided with the core bracket 515, and the housing 61 may be provided with the core mounting portion 619. The core 511 may be fixed to the housing 61 through the core fastening portion 517 by which the core bracket 515 is fixed to the core mounting portion 619. The core mounting portion 619 may be provided as a protrusion that is formed to protrude from the circumferential surface of the second housing 61*b* in the longitudinal (diameter) direction of the second housing 61*b*.

Figure 5:
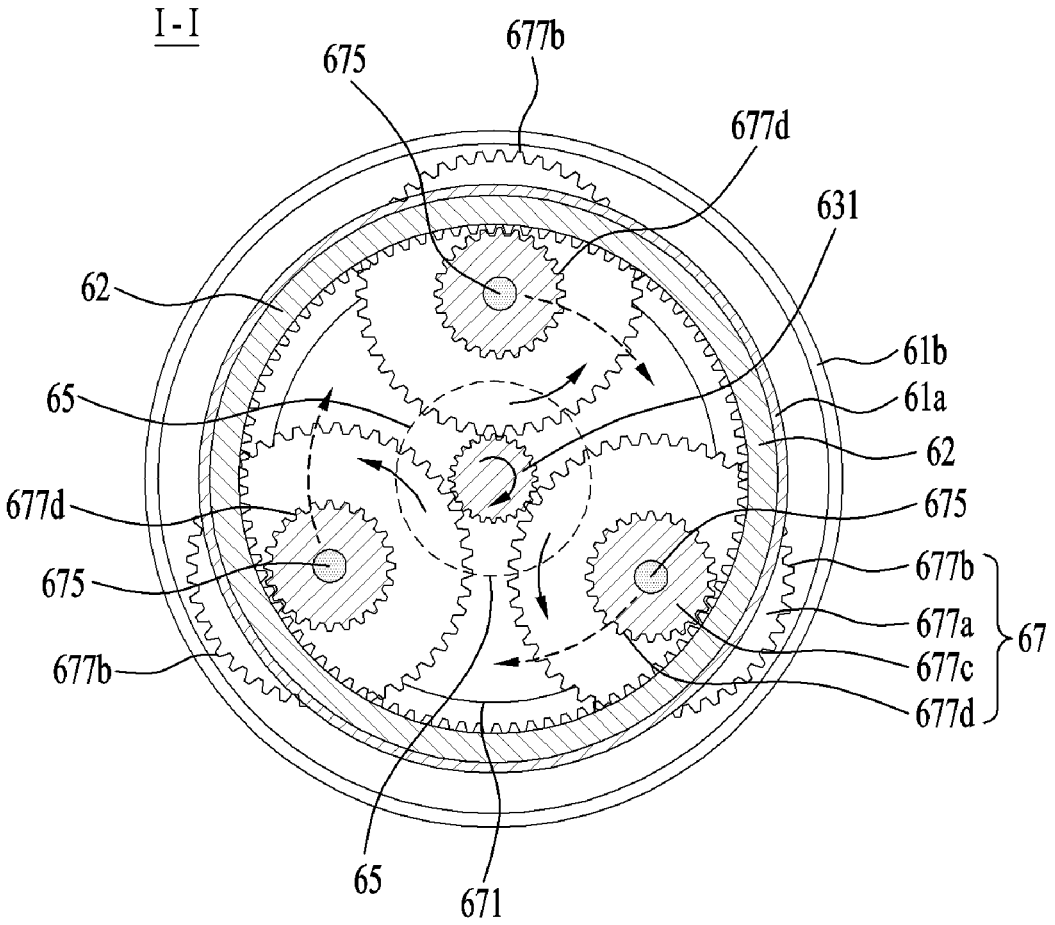

The driver D having the above-mentioned constituent elements will operate as follows. Referring to FIG. 5, when the rotor 52 rotates clockwise, the first shaft 63 and the main gear 631 may also rotate clockwise.

When the main gear 631 rotates clockwise, the slave gears 677 will rotate counterclockwise by the first gear 677*b*. When the first gear 677*b* rotates counterclockwise, the second gear 677*d* may also rotate counterclockwise. Since the ring gear 62 is fixed to the fixing panel 15, the base 671 and the second shaft 65 will rotate clockwise when the second gear 677*d* rotates counterclockwise. Since the drum 2 is connected to the base 671 through the second shaft 65, it is expected that the drum 2 will rotate in the same direction as the rotor 52.

When the stator 51 is fixed to the housing 61, concentricity between the first shaft 63 and the second shaft 65 and the spacing between the stator and the rotor can be easily maintained. For convenience of description, it is assumed that the stator 51 is fixed to the fixing panel 151 rather than the housing 61. In this case, it is expected that vibration of the drum and vibration of the fixing panel 151 will be transmitted to the second shaft 65 and vibration of the fixing panel 151 will be transmitted to the first shaft 63. This means that the vibration width of the drum 2 may be different from the vibration width of the fixing panel 151. If necessary, there may arise an unexpected situation in which not only the spacing and concentricity between the first shaft and the second shaft, but also the spacing between the coil 513 of the stator and the permanent magnet 525 of the rotor are difficult to be kept at desirable levels. However, assuming that the stator 51 is fixed to the housing 61, vibration transferred from the outside to the first shaft becomes identical to vibration transmitted from the outside to the second shaft, so that the above problem can be solved.

As depicted in the drawings, the diameter of the first gear 677*b* may be longer than the diameter of the main gear 631. The diameter of the second gear 677*d* may be longer than the diameter of the main gear 631, and may be shorter than the diameter of the first gear 677*b*. Although not shown in the drawings, the diameter of the second gear 677*d* may also be identical to the diameter of the main gear 631.

Assuming that the first gear, the second gear, and the main gear are configured as described above, the driver D may control the drum 2 to rotate at a lower RPM than the rotor 52. That is, the driver D may also serve as a decelerator.

Figure 6:
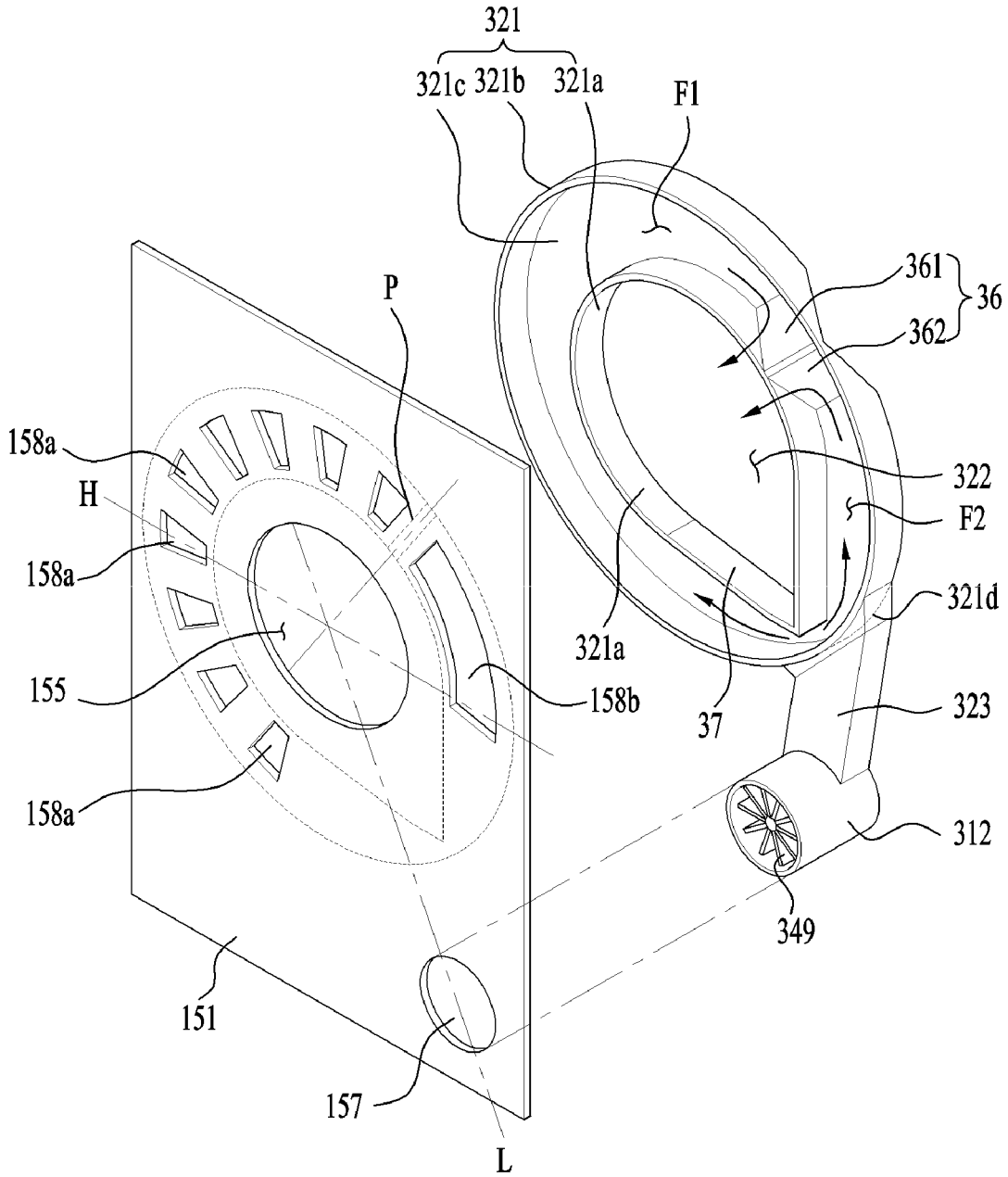
FIG. 6 is a schematic diagram illustrating an example of a supply duct according to the present disclosure.

As described above, a supply port 158 in which a plurality of through-holes 158*a* and 158*b* is arranged in a ring shape may be provided in the fixing panel 151. As shown in FIG. 6, the number of through-holes disposed over a horizontal line H formed to penetrate the center of rotation of the rotor 52 may be configured to be greater than the number of through-holes disposed below the horizontal line H.

Air introduced into the supply duct 32 through the fan 349 may move at a higher speed as the movement distance from the air to the fan 349 becomes shorter. As a result, there is a tendency that the amount of air flowing into the drum through some through-holes (i.e., through-holes located closer to the fan) disposed below the horizontal line H becomes greater than the amount of air flowing into the drum through other through-holes disposed over the horizontal line H. Therefore, assuming that the number of through-holes disposed over the horizontal line H is configured to be greater than the number of through-holes disposed below the horizontal line H, the amount of air flowing into the upper space of the drum may increase.

During rotation of the drum 2, laundry may move from the lower space of the drum to the upper space of the drum, and may tumble or drop into the lower space of the drum. In this case, if a large amount of air is supplied to the upper space of the drum, the possibility of contact between laundry and the air increases, resulting in reduction in the drying time of laundry. The above-mentioned effect may also be achieved when the sum of areas of the through-holes 158*a* and 158*b* disposed over the horizontal line H is greater than the sum of areas of other through-holes disposed below the horizontal line H.

The supply duct 32 may further include a barrier 36 through which the inner space of the duct body 321 is classified into a first flow passage F1 connected to some through-holes 158*a* from among the through-holes and a second flow passage F2 connected to the remaining through-holes 158*b* other than the through-holes 158*a*.

The barrier 36 may be disposed at a specific position P that is spaced apart from a reference line L in the direction from the reference line L (that penetrates the center of the rotor reception portion 322 and the center of the panel exhaust port 157 from among the space located above the horizontal line H) toward the panel exhaust port 157.

The amount of air supplied to the first flow passage F1 and the second flow passage F2 may vary depending on the rotational direction of the fan 349. That is, assuming that the fan 349 is configured to rotate counterclockwise, it is expected that the first flow passage F1 shown in FIG. 6 will be a flow passage (e.g., the first flow passage is a flow passage for allowing the air to move clockwise) for allowing the air to flow in a direction opposite to the rotational direction of the fan 349, the second flow passage F2 may be a flow passage (e.g., the second flow passage is a flow passage for allowing the air to move counterclockwise) for allowing the air to flow in the same direction as the rotational direction of the fan 349. In this case, the amount and speed of air supplied to the first flow passage F1 may be different from the amount and speed of air supplied to the second flow passage F2.

In order to enable the amount of air supplied to the drum through the first flow passage F1 to be kept similar to the amount of air supplied to the drum through the second flow passage F2, it is preferable that the length of the first flow passage F1 and the length of the second flow passage F2 be configured to be different from each other. That is, it is preferable that the number of through-holes 158*a* formed to receive air from the first flow passage F1 be configured to be different from the number of through-holes 158*b* formed to receive air from the second flow passage F2. FIG. 6 illustrates one example in which the number of through-holes 158*a* connected to the first flow passage F1 is greater than the number of other through-holes 158*b* connected to the second flow passage F2.

Referring to FIG. 6, the through-holes 158*a* connected to the first flow passage may be configured in a manner that a plurality of holes is arranged in the direction from the barrier 36 toward the second exhaust port 157, and the through-holes 158*b* connected to the second flow passage may be provided as one hole that is in contact with the barrier 36 or is adjacent to the barrier 36.

Alternatively, a lower end of the through-holes 158*b* connected to the second flow passage may be disposed over the horizontal line H, and an upper end of the through-holes 158*b* may be disposed below the barrier 36.

The barrier 36 may be provided as a curved surface formed when the cover body 321*c* is bent toward the fixing panel 151. A free end of the curved surface may be provided to contact the fixing panel 151 (e.g., the first flow passage and the second flow passage are provided to be completely distinguished from each other), or may also be spaced apart from the fixing panel 151 by a predetermined distance. In order to prevent the speed of air flowing in the first flow passage F1 and the speed of air flowing in the second flow passage F2 from abruptly decreasing in the vicinity of the barrier 36, it may be preferable that the barrier 36 be configured to discriminate between the two flow passages F1 and F2. In other words, in order to prevent reduction in the speed of air flowing into the drum, the barrier 36 may be configured to completely distinguish the two flow passages F1 and F1 from each other.

The curved surface may include a first inclined surface 361 where the cover body 321*c* is inclined downward toward the fixing panel 151, and a second inclined surface 362 where the cover body 321*c* is inclined downward toward the free end of the first inclined surface 361. If the curved surface is provided as two inclined surfaces 361 and 362, flow resistance generated when the movement direction of the air switches to another direction in which the through-holes 158*a* and 158*b* are disposed can be minimized.

The duct body 321 may further include a guide 37 formed to protrude from the inner body 321*a* toward the center of the communication hole 321*d*. The guide 37 may guide air discharged from the communication hole 321*d* to the first flow passage F1 and the second flow passage F2, and may minimize flow passage resistance generated when the air discharged from the communication hole 321*d* is distributed to the flow passages F1 and F2.

Although not shown in the drawings, the barrier 36 may be formed as a protrusion for interconnecting the cover body 321*c* and the fixing panel 151. In this case, the free end of the protrusion may be connected to the fixing panel 151, or may be spaced apart from the fixing panel 151.

In addition, the barrier 36 may be implemented as any one of a first protrusion protruding from the inner body 321*a* toward the outer body 321*b* and a second protrusion protruding from the outer body 321*b* toward the inner body 321*a*.

As illustrated in FIG. 1, whereas the rear cover 23 is maintained to be coupled to the fixing panel 15 through the driver D, the front cover 22 of the drum may be in contact with the drum connection body 123 of the support panel through the connection damper 124.

Accordingly, when the drum 2 moves to the rear side (i.e., in the X-axis direction) of the laundry treatment apparatus due to occurrence of vibration, there is a possibility of the front cover 22 being unexpectedly separated from the drum connection body 123.

When the front cover 22 is separated from the drum connection body 123, it is expected that the drum inlet 221 will be separated from the support panel through-hole 122, so that there arise unexpected problems, for example, waste of energy, an increased drying time, a reduction in drying efficiency, etc.

In addition, if the front cover 22 is separated from the drum connection body 12, laundry may be caught in a gap between the front cover and the drum connection body, so that a large load may occur in the motor.

In order to address the above-mentioned problems, the laundry treatment apparatus 100 may further include at least one of the rear support 9 supporting the rear cover 23 and the front supports 7 and 8 supporting the front cover 22. FIG. 1 illustrates one example of the laundry treatment apparatus 100 including both the rear support 9 and the front supports 7 and 8.

The front supports 7 and 8 may be provided to minimize movement of the support panel 121 that moves in the longitudinal direction (Z-axis direction) of the support panel 121 and in the latitudinal direction (Y-axis direction) of the support panel 121. The rear support 9 may be provided to minimize movement of the front cover 22 that moves in the direction (e.g., X-axis direction and −Z-axis direction) away from the support panel 12.

Referring to FIG. 2, the front support may include a first front support 7 configured to support the region disposed below the horizontal line H penetrating the center of rotation of the drum from among the circumferential surface of the front cover 22, and a second front support 8 configured to support the region disposed over the horizontal line H from among the circumferential surface of the front cover 22. The first front support 7 may include a first roller 71 and a second roller 73 that are rotatably fixed to the support panel 121.

The rear support 9 may support the region disposed below the horizontal line H formed to penetrate the center of rotation of the drum from among the circumferential surface of the rear cover 23. The rear support 9 may be fixed to the base panel 17, may be fixed to the fixing panel 12, or may be fixed to the base panel and the fixing panel.

Although the above-mentioned embodiments have disclosed examples of the laundry treatment apparatus 100 including a circulation-type drying system, the scope or spirit of the present disclosure is not limited thereto, and it should be noted that the laundry treatment apparatus 100 can also be applied to the exhaust-type drying system. The circulation-type drying system may refer to the drying machine that sequentially performs dehumidification and heating of the air discharged from the drum 2 and re-supplies high-temperature dry air to the drum. The exhaust-type drying system may refer to the drying machine that heats external air, supplies the heated air to the drum 2, performs heat exchange between the heated air and laundry in the drum 2, and finally allows air discharged from the drum 2 to be discharged to the outside of the cabinet 1.

When the laundry treatment apparatus 100 is implemented as the exhaust-type drying system, the supply unit 3 may include an exhaust duct for interconnecting the first exhaust port 128 and the second exhaust port 157, a supply duct for supplying external air (air inside the cabinet or air outside the cabinet) to the drum 2, and a heat exchanger for heating air introduced into the supply duct.

It will be apparent to those skilled in the art that the present disclosure may be embodied in other specific forms without departing from the spirit and essential characteristics of the disclosure. Thus, the above embodiments are to be considered in all respects as illustrative and not restrictive. The scope of the disclosure should be determined by reasonable interpretation of the appended claims and all change which comes within the equivalent scope of the disclosure are included in the scope of the disclosure.

What is claimed is:

1. A laundry treatment apparatus comprising:

a drum comprising:

a drum body that defines a space configured to receive laundry, a front cover that defines a front surface of the drum body, the front cover defining a drum inlet, and a rear cover that defines a rear surface of the drum body, the rear cover defining an air inlet;

a driver comprising a stator and a rotor, the rotor being configured to rotate relative to the stator to thereby rotate the drum;

a fixing panel that is spaced apart from the rear cover, that supports the stator, and that defines a panel exhaust port and a supply port, the supply port comprising a plurality of through-holes that pass through the fixing panel and surround the stator;

an exhaust duct configured to guide air discharged from the drum to the panel exhaust port;

a heat exchanger comprising:

a fan configured to cause the air to move along the exhaust duct, a heat absorber configured to dehumidify the air introduced into the exhaust duct, and a heater configured to heat the air having passed through the heat absorber;

a supply duct comprising a duct body that is fixed to the fixing panel and configured to guide the air discharged from the panel exhaust port to the supply port, the duct body defining a rotor reception portion that receives the rotor and that exposes the rotor to an outside of the duct body, wherein the plurality of through-holes comprise (i) first through-holes defined above a horizontal line passing through a center of the rotor and (ii) second through-holes defined below the horizontal line, and wherein:

a number of the first through-holes is greater than a number of the second through-holes, a total area of the first through-holes is greater than a total area of the second through-holes, or the number of the first through-holes is greater than the number of the second through-holes, and the total area of the first through-holes is greater than the total area of the second through-holes.

2. The laundry treatment apparatus according to claim 1, further comprising:

a barrier that divides an inside of the duct body into (i) a first flow passage connected to a first portion of the plurality of through-holes and (ii) a second flow passage connected to a second portion of the plurality of through-holes, wherein the barrier is located above the horizontal line and spaced apart from a reference line that passes through the center of the rotor and a center of the panel exhaust port.

3. The laundry treatment apparatus according to claim 2, wherein the first flow passage is configured to guide the air in a direction opposite to a rotational direction of the fan to thereby supply the air to a first number of the plurality of through-holes, and wherein the second flow passage is configured to guide the air in the rotational direction of the fan to thereby supply the air to a second number of the plurality of through-holes, the second number being different from the first number.

4. The laundry treatment apparatus according to claim 2, wherein the duct body comprises:

an inner body that is fixed to the fixing panel and defines the rotor reception portion;

an outer body fixed to the fixing panel and surrounds the inner body; and a cover body that connects the inner body to the outer body, and wherein the barrier is located at at least one of the inner body, the outer body, or the cover body.

5. The laundry treatment apparatus according to claim 4, wherein the barrier comprises a protrusion that connects the cover body to the fixing panel.

6. The laundry treatment apparatus according to claim 4, wherein the barrier comprises a protrusion that protrudes from the cover body toward the fixing panel, the protrusion having a first end connected to the cover body and a second end spaced apart from the fixing panel.

7. The laundry treatment apparatus according to claim 4, wherein the barrier comprises a protrusion that protrudes from the inner body toward the outer body or a protrusion that protrudes from the outer body toward the inner body.

8. The laundry treatment apparatus according to claim 4, wherein the barrier comprises a curved surface that is located at the cover body and bent toward the fixing panel, the curved surface having a first end connected to the cover body and a second end connected to the fixing panel.

9. The laundry treatment apparatus according to claim 4, wherein the barrier comprises a curved surface that is located at the cover body and bent toward the fixing panel, the curved surface having a first end connected to the cover body and a second end spaced apart from the fixing panel.

10. The laundry treatment apparatus according to claim 9, wherein the curved surface comprises:

a first inclined surface that is inclined with respect to the cover body and extends toward the fixing panel; and a second inclined surface that is inclined with respect to the cover body and extends toward an end of the first inclined surface.

11. The laundry treatment apparatus according to claim 4, wherein the outer body defines a communication hole configured to receive air from the panel exhaust port, and wherein the supply duct further comprises:

a connection body that connects the communication hole to the panel exhaust port, and a guide that protrudes from the inner body toward the communication hole, the guide being configured to guide a first part of the air received through the communication hole to the first flow passage and a second part of the air received through the communication hole to the second flow passage.

12. The laundry treatment apparatus according to claim 1, wherein the driver comprises:

a housing fixed to the fixing panel, the stator being fixed to the housing;

a ring gear fixed to an inside of the housing;

a first shaft having a first end fixed to the rotor and a second end located in the housing;

a main gear fixed to the first shaft and located in the housing;

a base located in the housing;

a second shaft that is concentric with the first shaft and passes through the fixing panel, the second shaft having a first end fixed to the rear cover and a second end that is located in the housing and fixed to the base; and a slave gear comprising:

a first body rotatably fixed to the base, a first gear defined at a circumferential surface of the first body and coupled to the main gear, a second body fixed to the first body, a diameter of the second body being less than a diameter of the first body, and a second gear defined at a circumferential surface of the second body and coupled to the ring gear.

13. The laundry treatment apparatus according to claim 1, wherein the air inlet of the rear cover comprises a plurality of holes that pass through the rear cover and are arranged along a ring shape about a center of rotation of the drum, and wherein a radius of the ring shape is greater than or equal to a half of a radius of the rear cover.

14. The laundry treatment apparatus according to claim 2, wherein the first portion of the plurality of through-holes includes at least one of the first through-holes and at least one of the second through-holes, and wherein the second portion of the plurality of through-holes includes at least one of the first through-holes and at least one of the second through-holes.

15. The laundry treatment apparatus according to claim 4, wherein the barrier has a distal end that faces the fixing panel, the barrier comprising:

a first inclined surface that is located in the first flow passage and extends from the cover body to the distal end of the barrier; and a second inclined surface that is located in the second flow passage and extends from the cover body to the distal end of the barrier.

16. The laundry treatment apparatus according to claim 15, wherein the distal end of the barrier is in contact with the fixing panel.

17. The laundry treatment apparatus according to claim 2, wherein the plurality of through-holes comprise a first hole that has a first area and a second hole that is located adjacent to the first hole, the second hole having a second area greater than the first area, and wherein a circumferential length of the second hole is greater than a circumferential length of the first hole.

18. The laundry treatment apparatus according to claim 17, wherein a distal end of the barrier is located between the first hole and the second hole.

19. The laundry treatment apparatus according to claim 17, wherein the reference line passes between the first hole and the second hole and is inclined with respect to the horizontal line.

20. The laundry treatment apparatus according to claim 1, further comprising a flow passage forming portion that connects the supply port and the air inlet to each other, the flow passage forming portion having a first end fixed to the fixing panel and a second end connected to the rear cover.

* * * * *